US005248988A

United States Patent [19]

Makino

[11] Patent Number: 5,248,988

[45] Date of Patent: Sep. 28, 1993

[54] ANTENNA USED FOR A PLURALITY OF FREQUENCIES IN COMMON

[75] Inventor: Mitsuya Makino, Warabi, Japan

[73] Assignee: Nippon Antenna Co., Ltd., Tokyo, Japan

[21] Appl. No.: 892,616

[22] Filed: Jun. 1, 1992

Related U.S. Application Data

[63] Continuation of Ser. No. 614,923, Nov. 16, 1990, abandoned.

[30] Foreign Application Priority Data

Dec. 12, 1989 [JP] Japan ..... 1-143944[U]

[51] Int. Cl.[5] ..... H01Q 9/16

[52] U.S. Cl. ..... 343/792; 343/715; 343/900; 343/790

[58] Field of Search ..... 343/792, 715, 900, 791, 343/790, 901, 903, 888

[56] References Cited

U.S. PATENT DOCUMENTS

| | | | |
|---|---|---|---|
| 4,540,989 | 9/1985 | Day, Jr. | 343/900 |
| 4,734,703 | 3/1988 | Nakase et al. | 343/905 |
| 4,829,316 | 5/1989 | Nakase et al. | 343/792 |
| 4,940,989 | 7/1990 | Austin | 343/792 |
| 4,968,991 | 11/1990 | Yamazaki | 343/715 |

FOREIGN PATENT DOCUMENTS

| | | | |
|---|---|---|---|
| 6478004 | 3/1989 | Japan . | |
| 690113 | 4/1953 | United Kingdom | 343/792 |

*Primary Examiner*—Donald T. Hajec
*Assistant Examiner*—Hoanganh Le
*Attorney, Agent, or Firm*—Flynn, Thiel, Boutell & Tanis

[57] ABSTRACT

An antenna used for a plurality of frequencies in common according to the present invention has two signal feeding systems for an integrated antenna. The antenna is so constructed that the signal feeding systems are perfectly isolated in DC from each other through a capacitor and at the same time in high frequency, only the signal system for the car telephone frequency band, which is a communication with a moving body, is coupled with the whole antenna, while the signal system for the AM/FM radio frequency band is separated from the antenna radiator portion (radiating element) working at the car telephone frequency band. Owing to a great difference in the frequency between the AM/FM radio frequency band and the car telephone frequency band, no disturbance such as mutual interference, etc. is produced and thus it is possible to obtain stable signal systems separated from each other.

6 Claims, 4 Drawing Sheets

ANTENNA USED FOR A PLURALITY OF FREQUENCIES IN COMMON

This application is a continuation of U.S. Ser. No. 07/614 923, filed Nov. 16, 1990, now abandoned.

FIELD OF THE INVENTION

The present invention relates to an antenna used for a plurality of frequencies in common and in particular to an improvement of an antenna, in which a receiving antenna for the AM radio frequency band (around 1,000 kHz) and the FM radio frequency band (around 80 MHz) and a transmitting and receiving antenna for the frequency band for car telephone (in a frequency band between 800 MHz and 1,500 MHz) as a representative example used for communication with a moving body are integrated so that it can be used therefor in common.

BACKGROUND OF THE INVENTION

Most of the prior art antennas used for a plurality of frequencies in common had only one system feeding integrated antennas with signals and the signals of this one system were separated into different signal systems. This is because the integrated antennas themselves were so constructed that they were at a same potential both in DC and in high frequency (however distributions and phases are different in high frequency).

As described above, in the prior art antennas, there are many parts, in which antenna elements are used in common. In particular, an antenna for the frequency band for the car telephone is so constructed that it is included in an antenna for the AM/FM radio frequency band and that composite signals are obtained from the main body of the antenna through a feeder. Consequently, since it is impossible to separate signals in various frequency bands only by the main body of the antenna and it is necessary to integrate or mount externally a device such as a frequency separator apart from the main body of the antenna in order to separate different signals, it has a drawback that the cost is high.

Further, since a prior art antenna was constructed so as to include a car telephone frequency band antenna in the lower part and an AM/FM radio frequency band antenna in the whole, the body of the car had important influences particularly on the car telephone frequency band antenna, which had influences on the characteristics thereof.

Still further, since the prior art antenna has an inflexible construction, which cannot be deformed by an external force in the direction perpendicular to the antenna axis, it has a drawback that it is broken, when an external force exceeding the limit of strength of the construction material is applied thereto. This means that, in the case where it is mounted on a vehicle as a moving station, it is weak in vibration produced by the vehicle, vibration, shock, wind pressure and other external forces accompanied by the movement.

Other than the antenna used for a plurality of frequencies in common having only one signal in- and output system as described above, an antenna having two signal in- and output systems is disclosed e.g. in U.S. patent appplication Ser. No. 06/749,452, filed Jun. 27, 1985. This antenna is so constructed that a dipole portion (consisting of a sleeve and a radiator of $\frac{1}{4}\lambda$) constituting a car telephone frequency band antenna is mounted on a monopole portion constituting an AM/FM radio frequency band antenna so that they are insulated electrically and constructionally from each other so as to form 2 separate antennas. Consequently, since it has no portion used electrically in common in the antenna construction, it has a drawback that the constructional region occupied by the monopole section in the main body of the antenna is reduced and that as the result the reception efficiency is lowered.

Other similar prior art antennas are disclosed in U.S. Pat. Nos. 4,734,703 and 4,968,991. These antennas also have a car telephone antenna portion and an AM/FM antenna portion which are completely separate, and no portion is shared electrically. Therefore, they also involve the same problem, namely that the signal receiving efficiency of each antenna portion is low. In addition, separation of the respective antenna portions necessitates various circuits.

OBJECT OF THE INVENTION

Therefore the object of the present invention is to provide an antenna used for a plurality of frequencies in common having 2 signal in- and output systems and such construction that an integrated antenna itself can separate signals in different frequency bands.

SUMMARY OF THE INVENTION

In order to achieve the above object, an antenna used for a plurality of frequencies in common according to the present invention is characterized in that the central conductor of a first feeder from a first feeding portion in the antenna base portion is connected with a radiator portion located at the extremity portion of the antenna through the central portion of the antenna, that the outer conductor of the first feeder is coupled capacitively with a sleeve at the lower extremity of the radiator portion passing through the circumference of the central conductor through an insulator in a coaxial cable shape and at the same time the central conductor of a second feeder from a second feeding portion in the antenna base portion is connected with the sleeve passing through the outside of the outer conductor of the first feeder, and that the outer conductor of the second feeder is connected with a body of a vehicle at the antenna base portion.

In the antenna used for a plurality of frequencies in common thus constructed, the signal system for the car telephone frequency band and the signal system for the AM/FM radio frequency band are separated from each other by the antenna itself at the sleeve portion thereof and in this way it is possible to take out these signal systems from the first and the second feeding portion, respectively.

DETAILED DESCRIPTION

Figure 1:
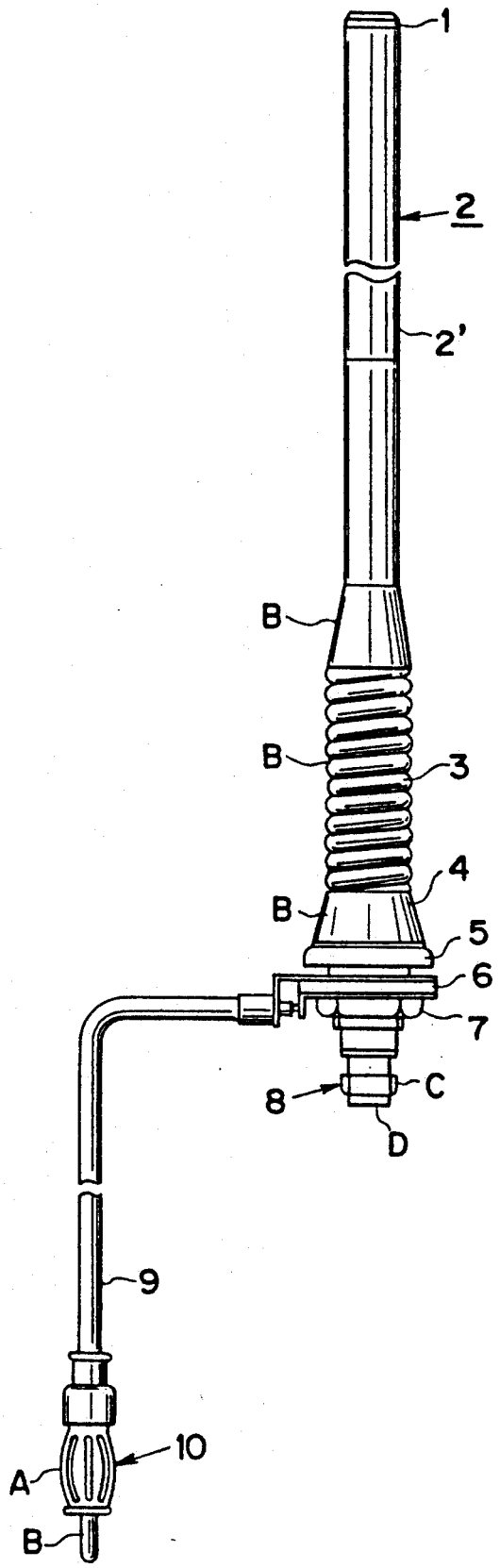
FIG. 1 is a scheme illustrating the outline of a first embodiment of the present invention.

Hereinbelow the present invention will be explained, referring to the embodiments indicated in the drawings. FIGS. 1 to 4 show an embodiment of the antenna used for a plurality of frequences in common, in which reference numeral 1 is an antenna top; 2 is an antenna element portion; 3 is a spring portion; 4 is a base portion; 5 is a pad; 6 is an AM/FM frequency; 7 is a hexagonal nut; 8 is a car telephone frequency band feeding portion; 9 is an AM/FM feeder; and 10 is a radio connector.

Figure 2:
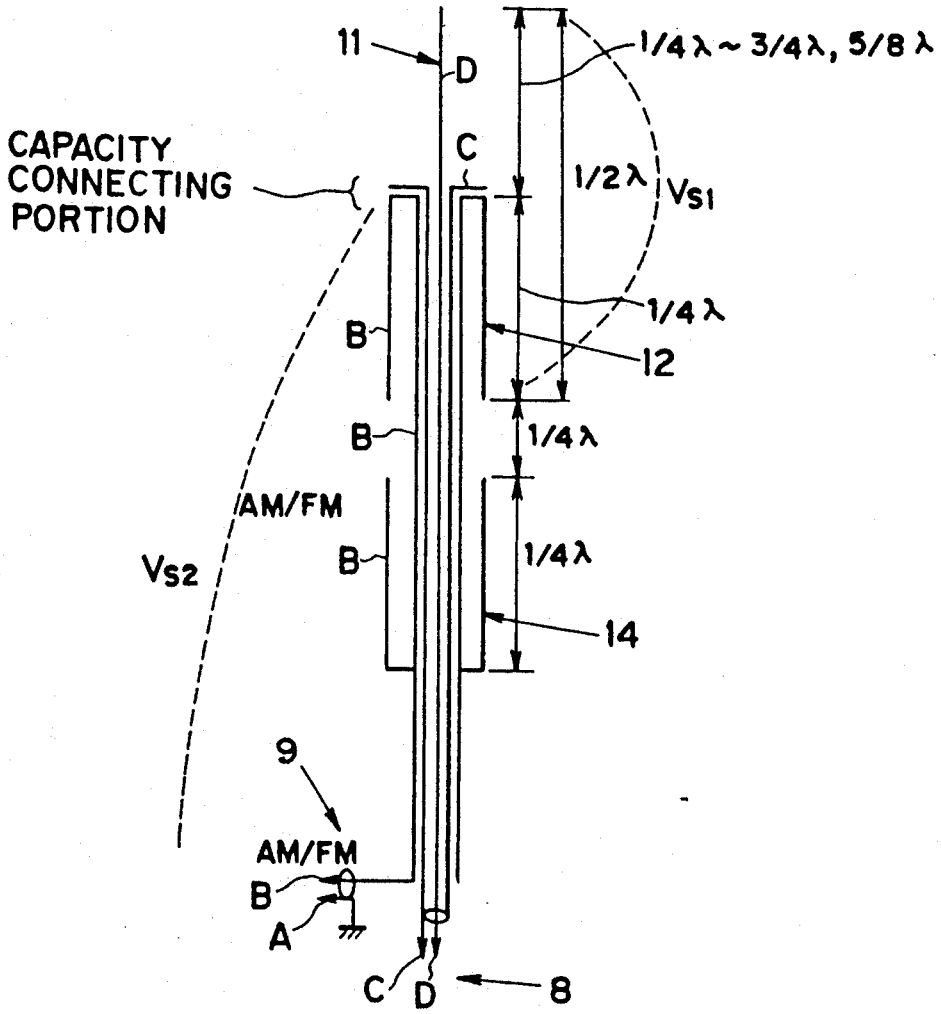
FIG. 2 is the outline indicating the electric construction of the interior of the main body of the antenna of the embodiment.
Figure 5:
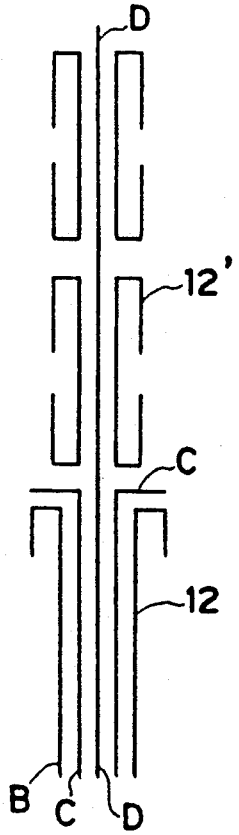
FIG. 5 shows an example of the construction of superposed sleeves.

The construction of the car telephone frequency band antenna portion in the base portion, the spring portion 3 and the antenna element portion is as indicated in FIG. 2. The central conductor D of the feeder from the feeding portion in the base portion 4 passes through the central portion of the antenna and is connected with the radiator portion 11 at the extremity portion of the antenna. Further the outer conductor C passes in the circumference of the central conductor D in a coaxial cable shape and is connected capacitively in high frequency with a sleeve 12 at the lower extremity of the radiator portion 11. The sleeve 12 acts as a hypothetical ground plane and it can be operated with a high efficiency, in the case where the radiator portion 11 is constructed in a whip type of $\frac{1}{4}\lambda$ ($\lambda$ representing a wavelength), $\frac{3}{4}\lambda$, $\frac{5}{8}\lambda$, etc. The capacitive coupling in high frequency between the outer conductor C and the sleeve 12 is useful for the car telephone frequency band. In a frequency band such as the AM/FM radio frequency band, which is lower than the car telephone frequency band, the coupling attenuation is great and it does almost not work as a coupling. Therefore it acts as a high pass filter. The cut-off frequency, which is the boundary between the pass region and the attenuation region in the high pass filter can be set arbitrarily by selecting suitably the capacity of the capacitive coupling. If there is no restriction on the total size of the antenna, a high gain can be realized by constructing the radiator portion 11 so that the sleeve 12 consists of three sections 12' superposed on each other e.g. as indicated in FIG. 5.

Further frequency vs. impedance characteristics as well as gain characteristics can be extended over a wide frequency band by increasing the width of the radiator portion 11, as far as it is tolerated from the point of view of the construction.

In FIG. 2, a broken line $V_{S1}$ represents the current distribution for transmission and reception by the car telephone, and another broken line $V_{S2}$ represents the current distribution for AM/FM reception. It is noted from FIG. 2 that, since capacitive connection is effective only in the car telephone frequency band, the radiator 11 and a part of the sleeve 12 operate as the car telephone antenna, while the sleeve 12 from its upper end to the antenna base 4 (ground connection) operates as the AM/FM antenna. Therefore, the antenna according to the invention has a portion electrically shared by the car telephone antenna portion and the AM/FM antenna portion, which improves the signal receiving efficiencies of the respective antenna portions.

Figure 3:
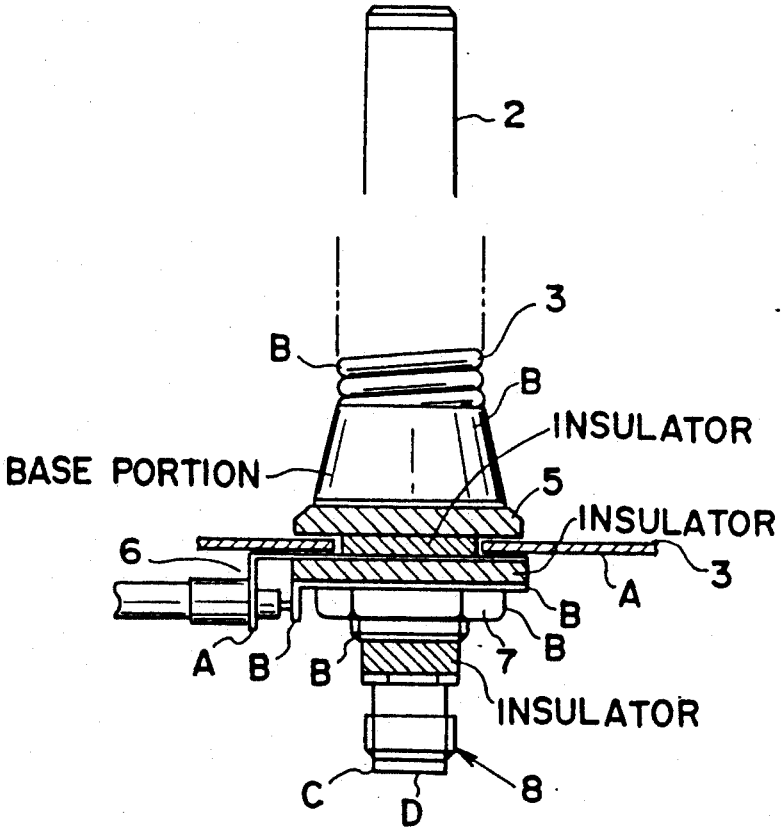
FIG. 3 is a scheme illustrating the outline of the construction of the base portion and the two feeding portion of the embodiment.

Next, in the AM/FM radio frequency band antenna, feeding of the antenna (taking out of signals) is effected by the radio connector 10 at the extremity of the feeder 9 therethrough from the base portion 4. The outer conductor A of the radio connector 10 is, in the case of an automobile, grounded in the base portion 4 with the body 13, as indicated in FIG. 3. On the other hand, the central conductor B is connected with the base portion 4 and connected with the sleeve 12 directly under the radiator portion 11 of the car telephone frequency band antenna portion. Since the sleeve 12 acts as a top loading for the AM/FM radio frequency band antenna portion, it can increase the effective length of the antenna element, which increases the reception (radiation) efficiency. In this way, the AM/FM radio frequency band antenna is constructed in the form of a whip antenna from the top portion of the sleeve to the base portion 4.

Figure 4:
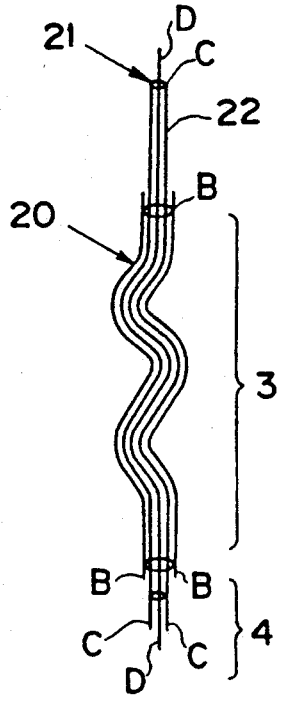
FIG. 4 shows a braided wire in a spring portion in the embodiment stated above.

Since the spring portion 3 is wound closely, as evident from FIG. 2 and in a manner similar to that shown in U.S. Pat. No. 4,540,989, when high frequency current is made flow through the spring portion 3 (central conductor B), in the stationary state current flows in the axial direction of the wound spring over the smallest distance However, when the protecting tube 2' of the element portion 2 is inclined, since the spring portion 3 is bent so as to be wound partially roughly, the length of the path, through which the current flows, is changed. Therefore there is a possibility that variations are produced in characteristics of the antenna. Therefore, according to the invention, these variations are alleviated or avoided by using a braided wire having elongated holes within the spring portion 3. In the present embodiment, as indicated in FIG. 4, the bending of the spring portion 3 described above is absorbed by using a multi-layered coaxial feeder, in which coaxial feeders C and D for the car telephone frequency band antenna portion are disposed at the center of the braided wire 20 stated above constituting the central conductor B for the AM/FM radio frequency band antenna portion. In the figure, 21 is an inner conductor of the coaxial cable and 22 is an outer conductor of the coaxial cable. In the base portion 4, the space between B, C and D is filled with an insulator.

Furthermore, since the antenna according to the present invention consists of the antenna main body and the spring portion disposed at the lower extremity of the antenna main body so as to have a function to make the antenna flexible, it is possible to alleviate bending and destruction of the antenna main body by external force in the direction perpendicular to the axial direction thereof and thus to remove satisfactorily the drawbacks of the prior art techniques, when it is mounted on a moving station.

Further, for the construction of the antenna main body, since the conductive feeders pass through the central portion of the spring portion, the spring portion may be made of metal or resin, or another elastic substance such as metal-resin composite material, and it is not necessary to expect any conductivity. Therefore, since the material and the shape can be selected arbitrarily, taking only the construction (strength, weight and design) and the cost into account, it is not restricted to a metallic spring, etc. as by the prior art techniques.

In particular, if the antenna according to the present invention has a prior art inflexible structure, it is also possible that the AM/FM frequency band antenna portion (antenna portion used for the car telephone frequency band in common) has a multi-stage telescopic structure so as to be extendible.

As clearly seen from the above explanation, according to the present invention excellent effects are obtained as described below.

(i) It is possible to separate signals of the two systems for the AM/FM frequency band and the car telephone frequency band by the integrated antenna main body and to take out them through the feeders of the two systems.

(ii) In the antenna according to the present invention, the sleeve portion of the dipole portion (or sleeve superposition colinear portion elevate feed type whip portion) is used electrically in common as the top loading of an AM/FM frequency band monopole antenna. Further, in the case where it has a same total length as a prior art antenna, in the prior art antenna a length corresponding to the insulator insulating different partial antennas is added to the length $\frac{1}{4}\lambda$ of the sleeve portion for the car telephone frequency band and therefore the actual length of the antenna is increased. At the same time, by the top loading effect described above the antenna length is electrically increased and the reception efficiency of the monopole antenna is increased remarkably with respect to the prior art antenna.

(iii) In the antenna according to the present invention, since the monopole antenna portion is used in common wholly with the car telephone frequency band antenna, it is possible to dispose a current obstructing insulating tube (Sperrtopp) 14 stopping leak current from the car telephone frequency band antenna portion under the open end of the sleeve 12 away therefrom by about $\frac{1}{4}\lambda$. As the result, it is possible to alleviate mutual influences of the car telephone frequency band antenna portion with the moving body. Further, since it is located at the upper portion of the antenna main body, when the car telephone frequency band antenna is mounted, it is possible to make the directivity thereof uniform for all the directions on a horizontal plane and thus to effect stable communication, independently of the direction of the moving body. As described above, the addition of the Sperrtopp tube has an effect both for the improvement of the directivity characteristics and for the stabilization of the impedance characteristics of the antenna itself. Since the prior art antenna used for a plurality of frequencies in common were composed of two partial antennas perfectly insulated from each other, it was impossible to add the Sperrtopp thereto as by the present invention and it had a problem in the stability also from the point of view of the electric characteristics (directivity characteristics, impedance characteristics).

What is claimed is:

1. In an antenna used for a plurality of frequencies in common including:

an antenna base portion disposed at a lower extremity of said antenna;

a radiator portion disposed at an upper extremity of said antenna;

a sleeve disposed between said antenna base portion and said radiator portion of said antenna;

a first feeder for a vehicle telephone frequency band connected with a first feeding portion at said antenna base portion;

a second feeder for an AM/FM radio frequency band connected with a second feeding portion at said antenna base portion; and a current obstructing insulating tube disposed under said sleeve to obstruct a leak current of vehicle telephone frequencies;

wherein a central conductor of said first feeder from said first feeding portion in said antenna base portion is connected with said radiator portion located at said upper extremity of said antenna through a central portion of said antenna;

wherein a central conductor of said second feeder from said second feeding portion in said antenna base portion is connected with said sleeve and said sleeve has passing therethrough an outer conductor of said first feeder; and wherein an outer conductor of said second feeder is connected with a vehicle body at said antenna base portion;

the improvement comprising means for causing said radiator portion and a part of said sleeve to operate as a vehicle telephone antenna, for causing said sleeve to operate as a top loading in the AM/FM frequency band, and for causing a portion of said sleeve between an upper extremity of said sleeve and said antenna base portion to operate as an AM/FM antenna, including said outer conductor of said first feeder being coupled capacitively with said sleeve at a lower extremity of said radiator portion in the vehicle telephone frequency band, having passing therethrough said central conductor of said first feeder in a coaxial cable shape so that said radiator portion and said part of said sleeve operate as a vehicle telephone antenna, and being free of capacitive coupling with said sleeve in the AM/FM radio frequency band so that the sleeve operates as a top loading in the AM/FM radio frequency band, and so that said portion of said sleeve between an upper extremity of said sleeve and said antenna base portion operates as an AM/FM antenna.

2. An antenna used for a plurality of frequencies in common according to claim 1, wherein said sleeve and said tube are spaced by a distance which is approximately $\lambda/4$.

3. An antenna used for a plurality of frequencies in common according to claim 1, including a second sleeve which has said radiator portion extending therethrough and which is spaced upwardly from said sleeve capacitively coupled to said outer conductor.

4. An antenna used for a plurality of frequencies in common according to claim 3, including a third sleeve which has said radiator portion extending therethrough and which is spaced upwardly from said second sleeve.

5. An antenna used for a plurality of frequencies in common, comprising:

an antenna base portion disposed at a lower extremity of said antenna;

a radiator portion disposed at a upper extremity of said antenna;

a sleeve disposed between said antenna base portion and said radiator portion of said antenna;

a first feeder for a vehicle telephone frequency band connected with a first feeding portion at said antenna base portion;

a second feeder for an AM/FM radio frequency band connected with a second feeding portion at said antenna base portion; and a current obstructing insulating tube disposed under said sleeve to obstruct a leak current of vehicle telephone frequencies;

wherein a central conductor of said first feeder from said first feeding portion in said antenna base portion is connected with said radiator portion located at said upper extremity portion of said antenna through a central portion of said antenna;

wherein a central conductor of said second feeder from said second feeding portion in said antenna base portion is connected with said sleeve and said sleeve has passing therethrough an outer conductor of said first feeder; and wherein an outer conductor of said second feeder is connected with a vehicle body at said antenna base portion;

wherein said outer conductor of said first feeder is coupled capacitively with said sleeve at a lower extremity of said radiator portion in the vehicle telephone frequency band, has passing therethrough said central conductor of said first feeder in a coaxial cable shape so that said radiator portion and a part of said sleeve operate as a vehicle telephone antenna, and is free of capacitive coupling with said sleeve in the AM/FM radio frequency band so that the sleeve operates as a top loading in the AM/FM radio frequency band, and so that a portion of said sleeve between an upper extremity of said sleeve and said antenna base portion operates as an AM/FM antenna; and wherein a portion of said antenna which includes said radiator portion, said sleeve and said tube is supported on said antenna base portion by a helical coil portion made of a nonconductive material, said helical coil portion having ends which are respectively coupled to said base portion and to said sleeve.

6. An antenna used for a plurality of frequencies in common according to claim 5, wherein said central conductor of said second feeder includes a portion which extends upwardly through said helical coil portion and which is a braided wire having a central opening therethrough, said central conductor and said outer conductor of said first feeder extending through said central opening of said braided wire.

* * * * *

UNITED STATES PATENT AND TRADEMARK OFFICE

CERTIFICATE OF CORRECTION

PATENT NO. : 5,248,988

DATED : September 28, 1993

INVENTOR(S) : Mitsuya MAKINO

It is certified that error appears in the above-identified patent and that said Letters Patent is hereby corrected as shown below:

Column 6, line 62; delete "portion".
line 68; delete "and".

Signed and Sealed this
Twelfth Day of April, 1994

*Attest:*

*Attesting Officer*

BRUCE LEHMAN

*Commissioner of Patents and Trademarks*